US005423510A

United States Patent [19]

Almoslino

[11] Patent Number: 5,423,510

[45] Date of Patent: Jun. 13, 1995

[54] DECORATIVE COVERING FOR SHELF BRACKETS AND STANDARDS

[76] Inventor: Hans Almoslino, 190-17 Hillside Ave., Hollis, N.Y. 11423

[21] Appl. No.: 98,675

[22] Filed: Jul. 28, 1993

[51] Int. Cl.[6] ..... A47G 29/00

[52] U.S. Cl. ..... 248/345.1; 248/243

[58] Field of Search ..... 248/235, 241, 250, 243, 248/247, 248, 915, 345.1

[56] References Cited

U.S. PATENT DOCUMENTS

| | | | |
|---|---|---|---|
| 2,919,033 | 12/1959 | Lundovist | 211/147 |
| 3,604,670 | 9/1971 | Reeves | 248/250 |
| 3,606,229 | 9/1971 | Wall | 248/345.1 X |
| 3,687,410 | 8/1972 | Holmgren | 248/235 |
| 3,707,273 | 12/1972 | Bortz | 248/345.1 X |
| 3,984,077 | 10/1976 | Shine | 248/248 |
| 4,431,155 | 2/1984 | Engel | 248/243 |
| 5,253,835 | 10/1993 | Herron, III | 248/243 X |

FOREIGN PATENT DOCUMENTS

| | | | |
|---|---|---|---|
| 1927656 | 8/1979 | Germany | 248/243 |

*Primary Examiner*—Karen J. Chotkowski
*Attorney, Agent, or Firm*—Kenyon & Kenyon

[57] ABSTRACT

A decorative covering is provided for a shelving bracket in particular a bracket that is usually formed from sheet metal as an elongated, blade-like arm having mounting hooks engageable in selected slots of a vertical standard. The decorative covering is formed with a first groove for receiving conventional shelf bracket and a second groove for receiving a standard. When applied, the covering completely conceals both the horizontal blade and the vertical standard so as to enhance the appearance of a shelving system and provide the look of finished furniture.

4 Claims, 8 Drawing Sheets

DECORATIVE COVERING FOR SHELF BRACKETS AND STANDARDS

FIELD OF INVENTION

The present invention relates generally to shelving systems, and more specifically to those systems in which blade-like horizontal brackets for supporting a shelf are connected to vertical standards. The invention provides a decorative covering which is easily and inexpensively applied to shelving systems and has a cosmetic function in that it conceals both the bracket and the standard without detracting from the functionality thereof.

DESCRIPTION OF THE PRIOR ART

A very popular type of shelving system includes vertical standards having a longitudinal series of slots, so that when the standards are mounted on a vertical wall surface they may receive outwardly projecting, horizontal blade-like brackets. The brackets are usually provided with hooks to permit the brackets to be engaged in selected slots of the standards. In this way, the brackets are adapted to support shelves at selected locations and at selected distances from one another.

Conventional brackets of the type described are often formed from sheet metal material with nose portions that project beyond the front edges of the shelves to keep the shelves from sliding off the brackets. Brackets of this type, while wholly efficient for their intended use, are designed primarily for ease of installation by the ordinary homeowner. In accomplishing ease of installation, however, they detract from the attractiveness of the overall shelving system because the unattractive brackets and standards are exposed.

Attempts have been made in the prior art to enhance the appearance of shelving systems of the general type described above. It has been proposed, for example, to embed hooks or support plates within wooden shelf brackets to facilitate the attachment of the brackets to a standard. Basically, however, this has been accomplished only by discarding the shelf brackets now in use, and substituting completely new brackets or equivalent shelf mounts.

Other systems apply a sleeve-like covering to the bracket, however, these systems have several disadvantages. First, they cover only the bracket and do not cover the standard. Second, they require that the covering be secured using, e.g., shims or adhesive metal tape provided with gripping teeth or protrusions, thus, requiring additional assembly by the user. Still other systems secure the covering to the bracket by cutting a groove in the decorative covering which is slightly smaller than the bracket so that the bracket is held in place by friction. This limits the size of the bracket which may be employed and may permit the bracket to become dislodged.

The prior art thus has not solved the problem of easily and decoratively covering conventional shelf brackets and standards, in a manner which conceals both the unattractive horizontal blade-like arms and the unattractive vertical standards. The basic purpose of the present invention is to eliminate this deficiency noted in the prior art devices.

SUMMARY OF INVENTION

Summarized briefly, the invention is a decorative covering for shelving systems which can be ornamentally shaped in any manner desired. Typically, the decorative covering would be made from wood, however, a variety of materials well known as suitable for this purpose may be employed. By matching the decorative covering with the shelving, the brackets, shelves, and standards are given the appearance of fine finished cabinet work. The decorative coverings for the brackets and standards may be fashioned in contemporary, colonial, or other decors according to the taste of the particular purchaser.

The decorative covering comprising the present invention is adapted to be mass-produced in any of a wide variety of shapes, sizes, and materials that will accomplish the desirable aims set forth above. In every instance the decorative covering, regardless of its exterior configuration, has a horizontal groove which receives and conceals the horizontal metallic blade-like bracket and a vertical groove which receives and conceals the vertical standard. When the bracket is inserted it is secured within the decorative covering and the top edge of the bracket remains flush with the top surface of the decorative covering. The function of the bracket thus is retained, that is, the bracket continues to be the support for the shelf, although the covering appears to be discharging the support function. When the bracket, now inserted in the decorative covering, is attached to the standard, the decorative covering also covers the vertical standard, as well as the horizontal bracket, thus, imparting the appearance of finished furniture.

It is an object of this invention to provide a decorative covering for application to a shelving system of the type having a vertical standard and a horizontal blade-like shelf support bracket, comprising: (a) a decorative covering provided with a first groove for receiving the horizontal bracket and a second groove for receiving the vertical standard; and (b) engaging means for engaging the bracket, the engaging means adapted to receive the proximal end of the bracket and retain the bracket within the first groove and retain the standard within the second groove.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENTS

Figure 1:
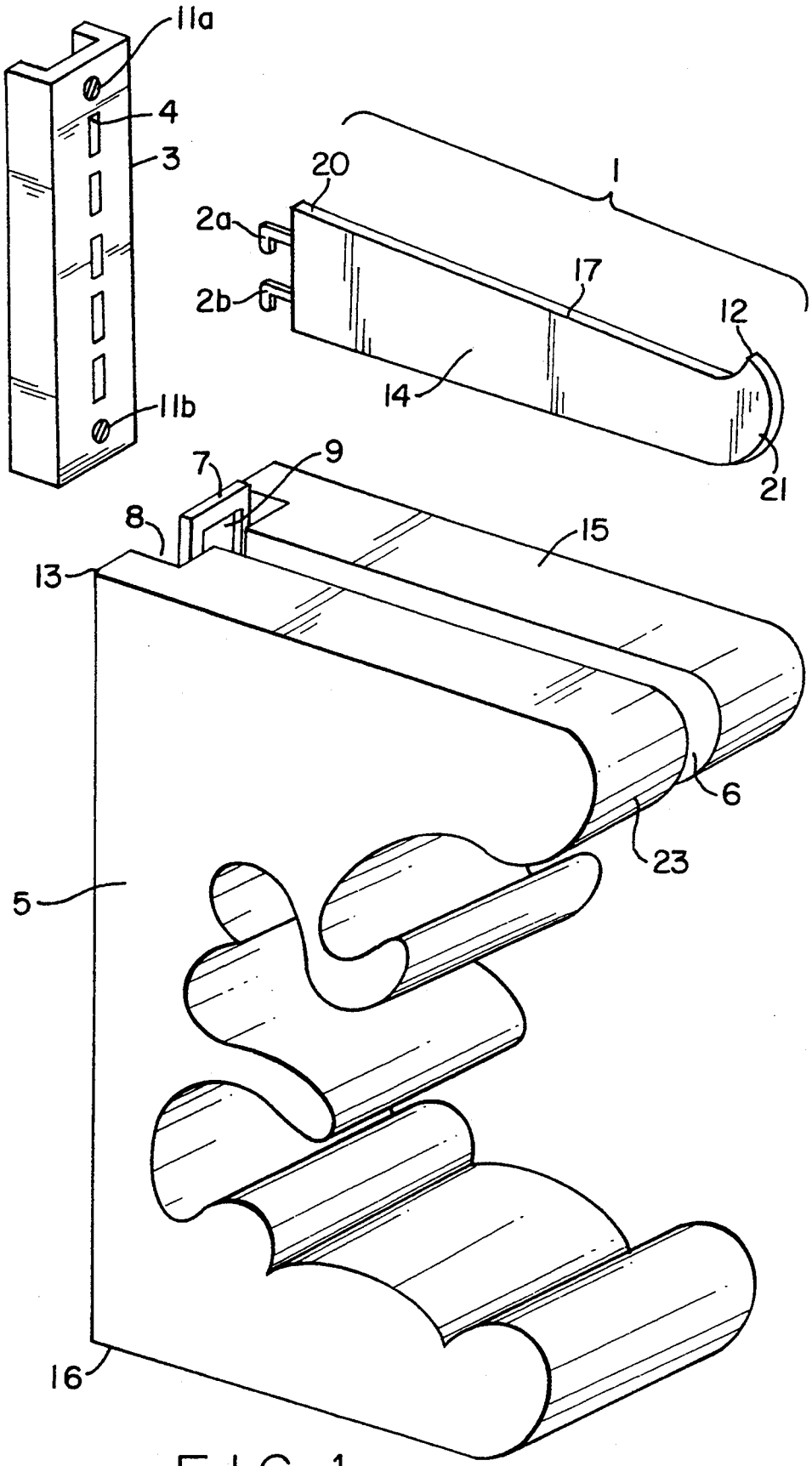
FIG. 1 is an exploded perspective view of a portion of a shelving system and of a decorative covering as it appears immediately prior to application to a horizontal bracket and a vertical standard.

A conventional horizontal standard 3 of a shelving system is in the form of a shallow metal channel having a longitudinal series of mounting slots 4, and adapted to be fixedly secured in a vertical position to a wall surface W. This is usually done via a plurality of screws 11*a* and 11*b*.

The shelving system also includes shelf support brackets, only one of which has been illustrated, generally designated 1. The conventional shelf bracket 1 is often provided with rearwardly projecting mounting hooks 2*a* and 2*b* which are insertable in slots 4. Hooks 2*a* and 2*b*, when inserted in slots 4 are thereafter forced downwardly with the slots 4 causing them to lock in the slots 4. The horizontal bracket 1 is thus securely mounted at a desired elevation for supporting a shelf S on the top surface 17 of bracket 1.

Bracket 1 has a proximal end 20, a distal end 21, and includes a distally projecting blade-like arm 14. Typically, arm 14 is formed with an upwardly projecting nose portion 12 which extends beyond the front edge of the supported shelf S. It thus confines the shelf S between the distal end 21 of the bracket arm 1 and the standard 3. This prevents the shelf from sliding forwardly off the bracket 1.

Figure 2:
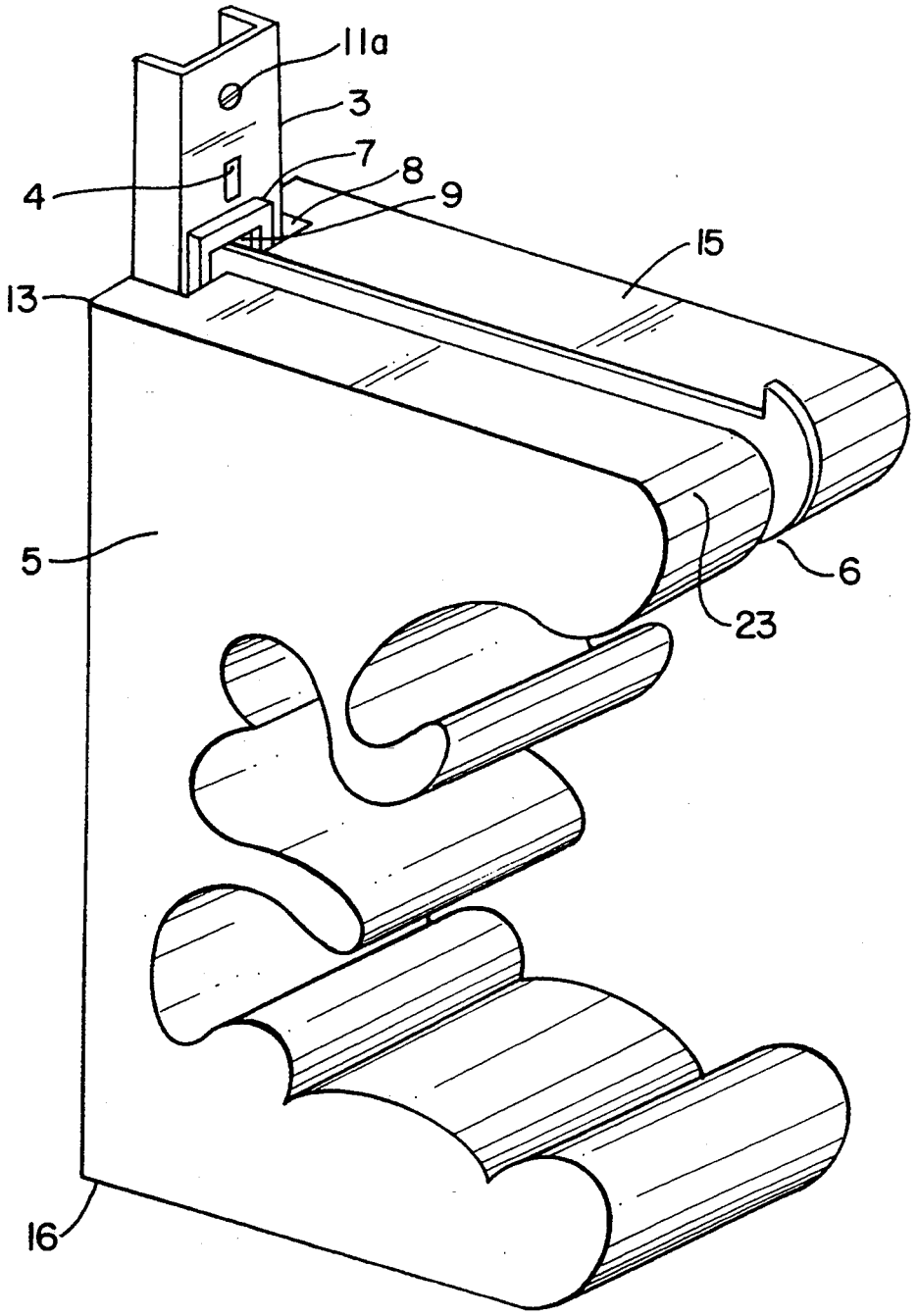
FIG. 2 is a perspective view of the shelving system shown in FIG. 1 and of a decorative covering as it appears immediately after application to a horizontal bracket and a vertical standard.

Decorative covering 5 has a proximal end 13, a distal end 23, a top end portion 15, a bottom end portion 16, and is provided with a first groove 6 adapted to receive and conceal horizontal bracket 1. Decorative covering 5 is also provided with a second groove 8 which is adapted to receive and conceal a vertical standard 3. The decorative covering 5 may be of any desired ornamental shape, and thus could be styled in a wide range of designs to harmonize with the decor of the room in which the shelving system would be mounted. As shown in FIG. 2, the first groove 6 is sufficiently wide and deep so that it will accommodate the entire blade portion of the bracket 1 and the second groove 8 is sufficiently wide and deep to accommodate the standard 3.

Decorative covering 5 may be formed from a single block or laminates of material, e.g., wood, or other materials known to those skilled in the art as suitable for this purpose. At this point, it may be noted that it could be molded of plastic material to a selected ornamental shape without detracting from the effectiveness of the invention.

Figure 3:
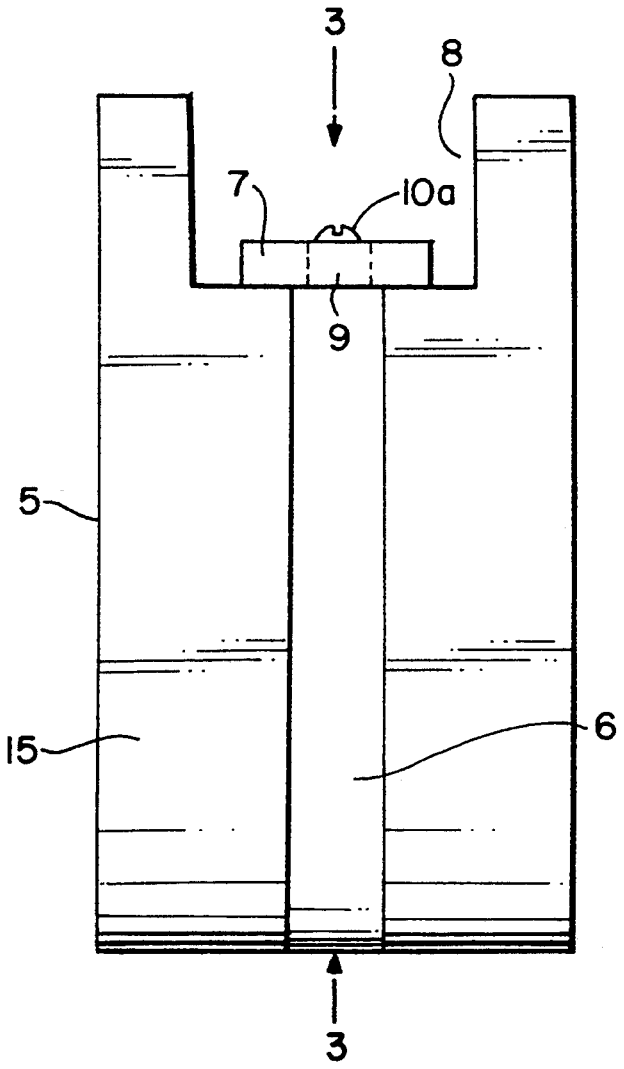
FIG. 3 is a top view of the decorative covering shown in FIGS. 1 and 2.
Figure 4:
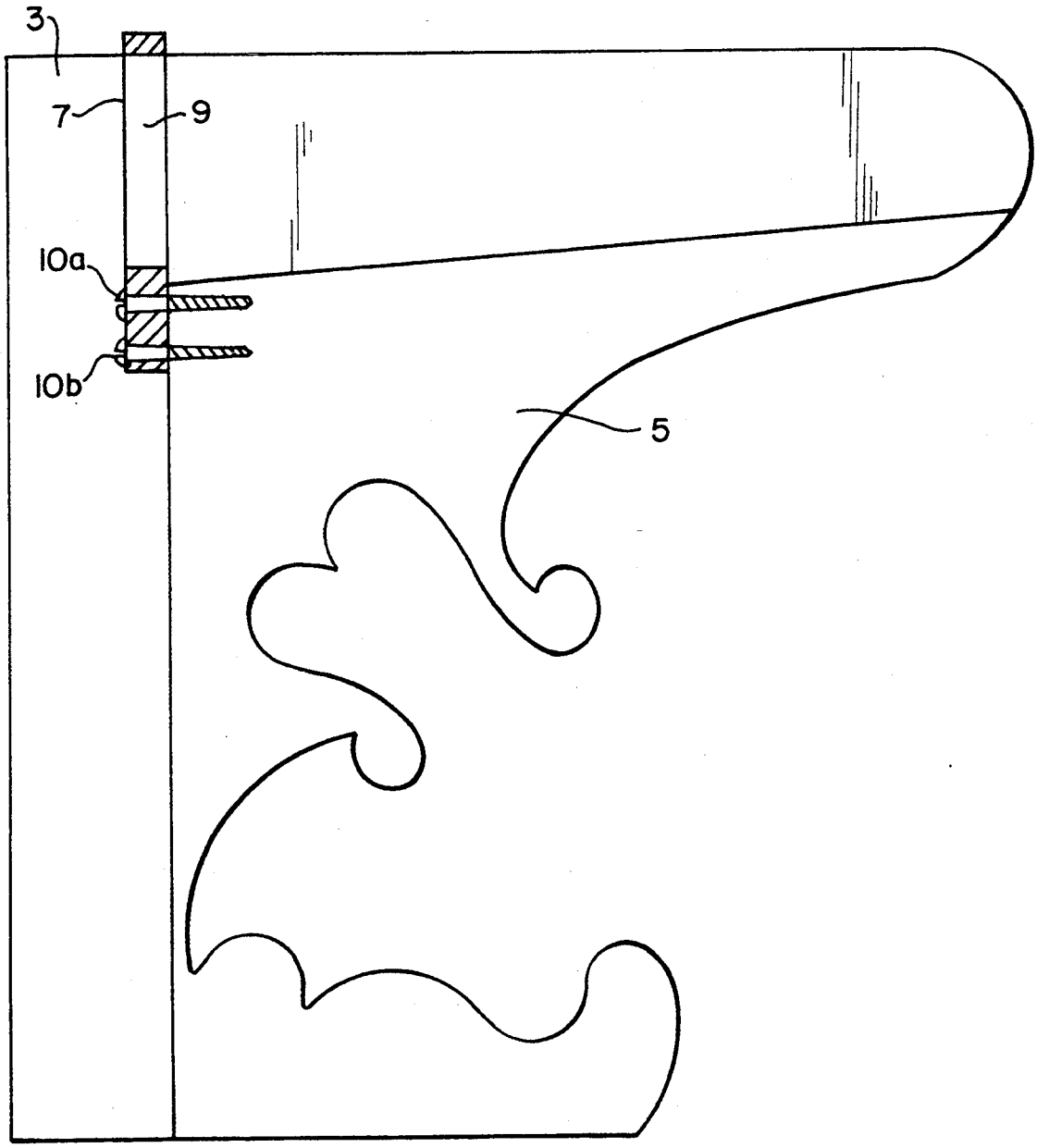
FIG. 4 is a transverse sectional view substantially on line 3—3 of the cover-sleeve of FIG. 3.
Figure 5:
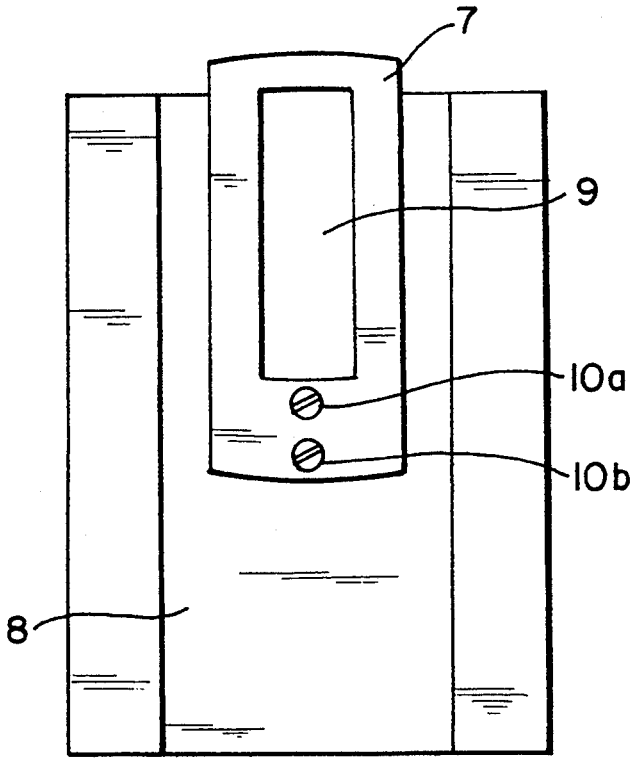
FIG. 5 is a back view of the decorative covering shown in FIG. 3.

In FIGS. 3, 4, and 5, the dimensions have been exaggerated solely for the purpose of illustrating the mechanical features of the invention. FIGS. 3, 4 and 5 shows bracket 5, first groove 6, second groove 8, engaging means 7, engaging means securing screw 10*a*, and engaging means securing aperture 9. In accordance with the invention, engaging means 7 is adapted to selectively attach the decorative covering 5 to bracket 1 when the bracket 1 has been fully inserted in the manner shown in FIGS. 6 and 7.

In a preferred embodiment, the engaging means 7 is flexible so as to allow it to be biased against a shelf S so as to help keep the shelf S in place between the engaging means 7 and upwardly projecting nose portion 12. The flexibility also allows the engaging means 7 to accommodate shelves of varying sizes.

Figure 6:
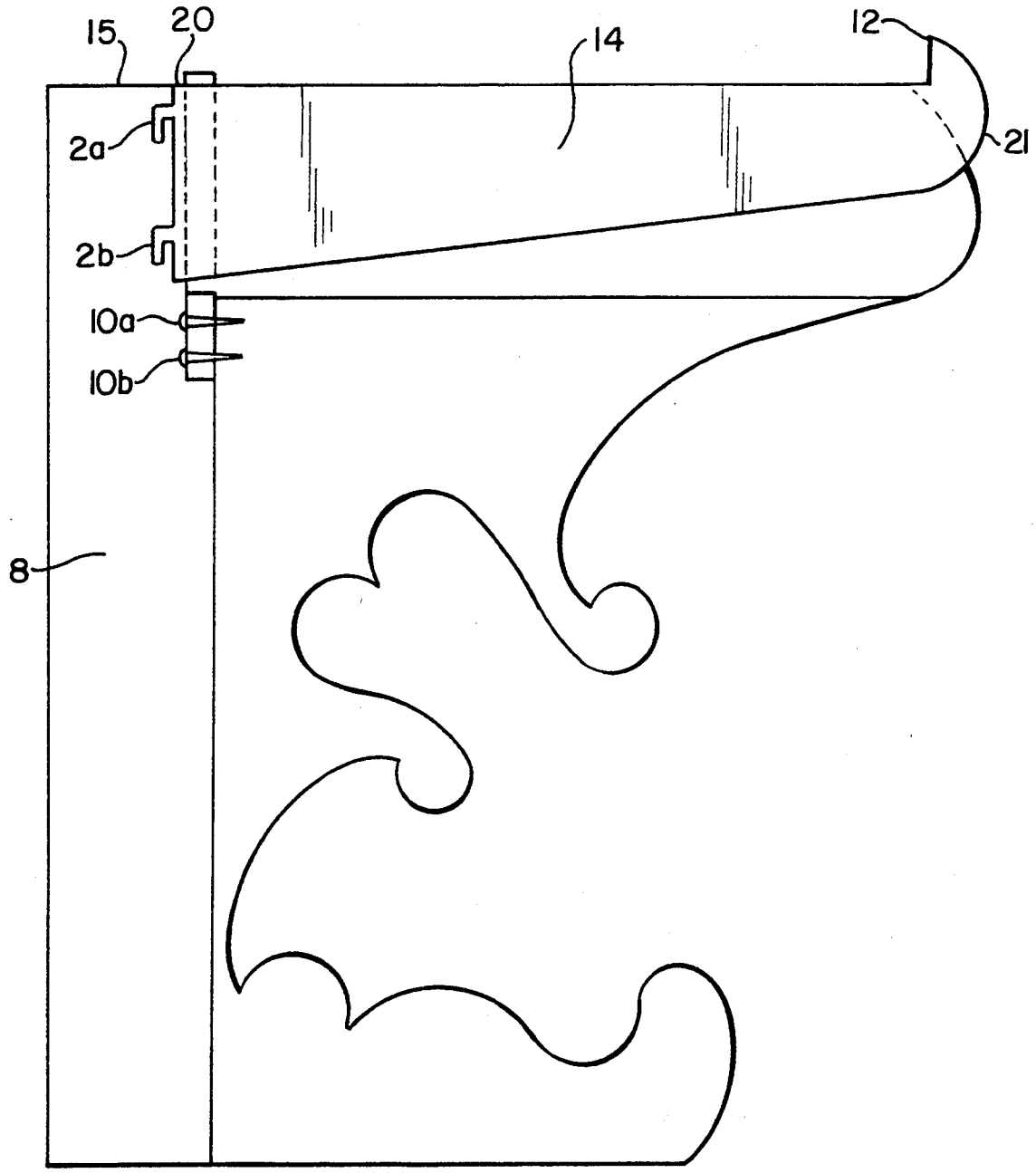
FIG. 6 shows the decorative covering shown in FIG. 4 applied to a bracket.
Figure 7:
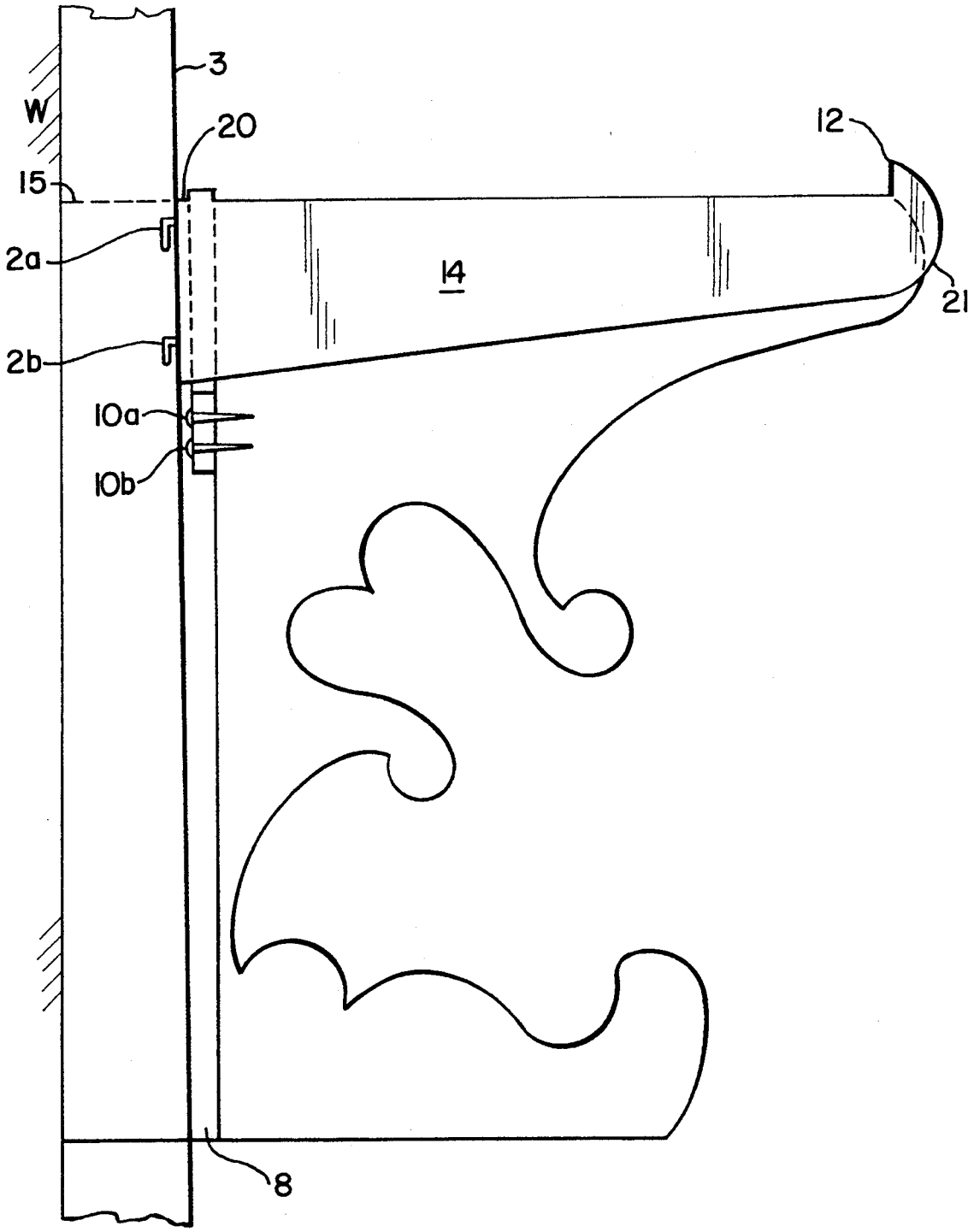
FIG. 7 shows the decorative covering and bracket shown in FIG. 6 attached to a standard.

When the bracket 1 is fully inserted into decorative covering 5, the top surface 17 thereof is flush with the top surface 15 of the sleeve 5, as shown in FIGS. 2, 6, and 7. As a result, the metal bracket 1 continues to be the support for the weight of the shelf S, although fully concealed by the decorative covering 5. In these circumstances, the cover-sleeve 5 is seemingly the sole support for the shelf S and the standard 3 is concealed within second groove 8.

The decorative covering 5, as previously noted, can be of any desired ornamental shape, so long as it retains the structural and functional characteristics described above. It could, thus, be exteriorly shaped to harmonize with the room decor of any desired furniture period. And, it can be stained, painted, or otherwise exteriorly finished as desired. The decorative covering 5 may also be provided with a nose portion at its distal end 23 to conceal the nose portion 12 of the bracket 1.

The device can be adapted to conventional brackets. This permits the brackets to be sold without covering sleeves or with decorative coverings of an appropriate size. The decorative coverings and the brackets would come in a selection of sizes, possibly in one-inch increments. The selection would be made according to the width of the shelves, and no modification in the conventional brackets now available and already in use is necessary.

Figure 8:
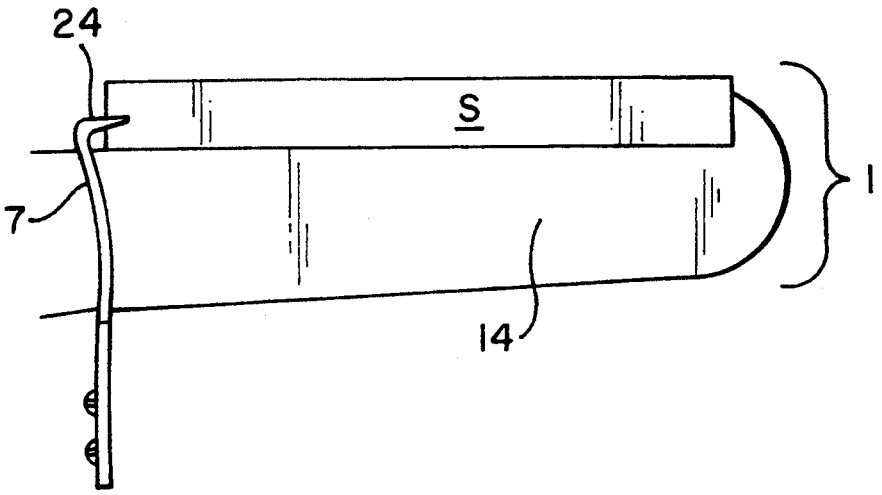
FIG. 8 shows an embodiment of the invention provided with a shelf securing means.
Figure 9:
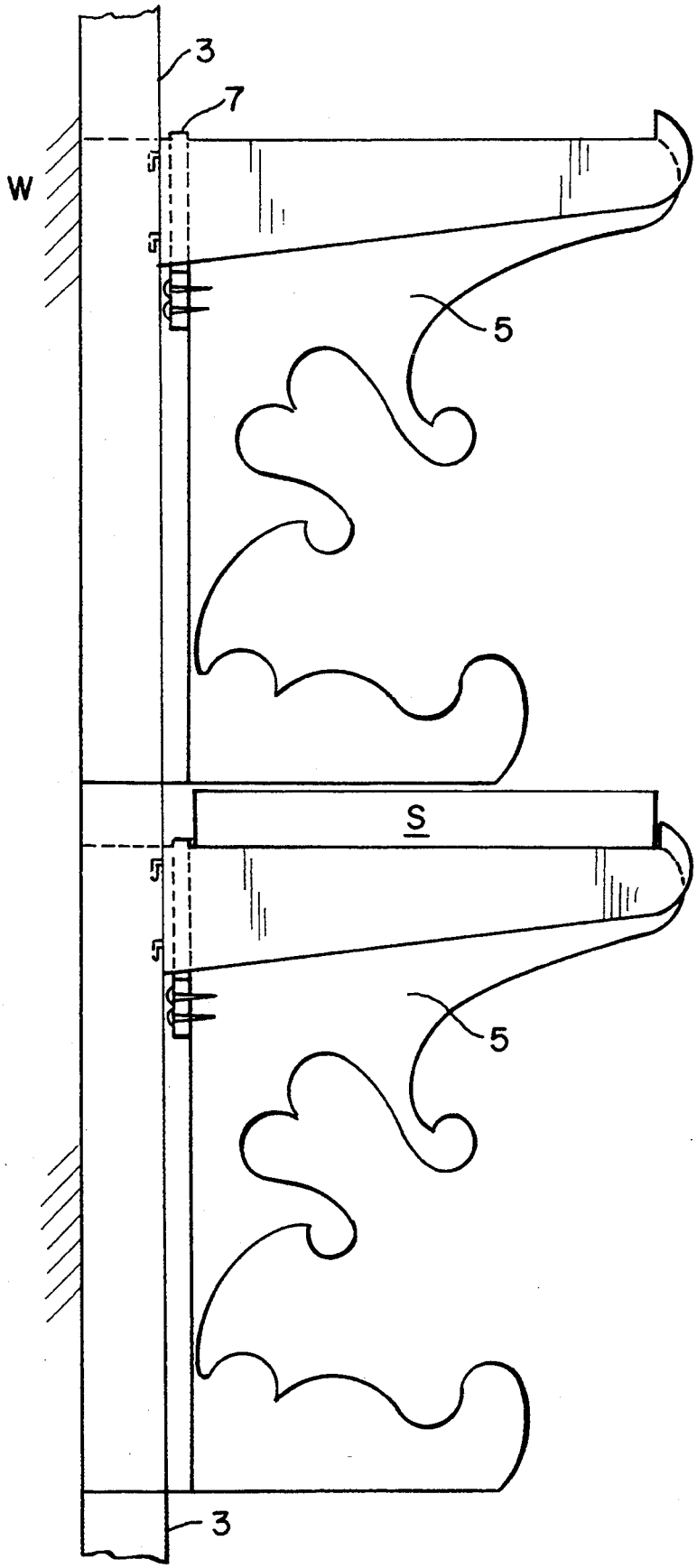
FIG. 9 shows an embodiment of the invention in which the bottom surface of the decorative covering rests on the shelf below it.

FIG. 8 shows another embodiment of the invention wherein the engaging means 7 is further provided with shelf securing means 24 for securing a shelf S between engaging means 7 and the distal end 21 of bracket 1. In a preferred embodiment, shelf securing means 24 comprises an angular projection adapted to be biased against and embedded within shelf S. This causes the shelf S to be effectively retained against accidental sliding movement off the support bracket 1. The same means can be provided, of course, in the form of the invention shown in FIGS. 1–4 and 7. It may be noted at this point that the danger of a shelf being jarred off its underlying support bracket 1 is minimized if the bottom end 16 of decorative covering 5 is adapted to extend to and touch, or be in close proximity to, the shelf below it as shown in FIG. 9. The embodiment shown in FIG. 9 has the additional advantage that the decorative covering 5 also acts as a book end to prevent articles from falling off the shelf S.

The device, it will be seen, permits sale of the decorative covering to individuals who have already installed brackets of the type illustrated. Or, the sleeve can be sold along with conventional brackets as shown. All of these arrangements are believed to fall within the scope of the concept as previously described and illustrated herein.

While particular embodiments of this invention have been shown in the drawings and described above, it will be apparent, that many changes may be made in the form, arrangement, and positioning of the various elements of the combination. In consideration thereof it should be understood that preferred embodiments of this invention disclosed herein are intended to be illustrative only and not intended to limit the scope of the invention.

What is claimed is:

1. A decorative covering for application to a shelving system of the type having a vertical standard and a horizontal blade-like shelf support bracket, comprising:

(a) a decorative covering provided with a first groove for receiving said horizontal bracket and a second groove for receiving said vertical standard; and (b) engaging means for engaging said bracket, said engaging means adapted to receive the proximal end of said bracket and retain said bracket within said first groove and retain said standard within said second groove, wherein said engaging means is a length of material having a first end and a second end said first end attached to said decorative covering, said engaging means provided with an aperture between said first end and said second end, said aperture in communication with said first groove and said second groove.

2. The decorative covering of claim 1, further comprising securing means for securing a shelf between said engaging means and the distal end of said bracket.

3. The decorative covering of claim 2, wherein said securing means is a protrusion attached to said second end of said engaging means, said protrusion adapted to be biased against said shelf to selectively secure said shelf between said protrusion and said distal end of said bracket.

4. The decorative covering of claim 1 wherein said engaging means is flexible.

* * * * *